US009987545B2

(12) United States Patent
Canaday et al.

(10) Patent No.: US 9,987,545 B2
(45) **Date of Patent: *Jun. 5, 2018**

(54) CAMBERED SNOWBOARD

(71) Applicant: Never Summer Industries, Inc., Denver, CO (US)

(72) Inventors: Tim Canaday, Brighton, CO (US); Tracey Canaday, Pine, CO (US)

(73) Assignee: Never Summer Industries, Inc., Denver, CO (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 14/727,613

(22) Filed: Jun. 1, 2015

(65) Prior Publication Data

US 2015/0290522 A1 Oct. 15, 2015

Related U.S. Application Data

(63) Continuation of application No. 13/623,776, filed on Sep. 20, 2012, now Pat. No. 9,044,664, which is a continuation of application No. 13/246,588, filed on Sep. 27, 2011, which is a continuation of application No. 12/877,864, filed on Sep. 8, 2010, now Pat. No. 8,029,013, which is a continuation of application No. 12/100,974, filed on Apr. 10, 2008, now Pat. No. 7,798,514.

(51) Int. Cl.
*A63C 5/03* (2006.01)
*A63C 5/04* (2006.01)

(52) U.S. Cl.
CPC ..... *A63C 5/0405* (2013.01); *A63C 5/03* (2013.01); *A63C 5/04* (2013.01); *Y10T 156/1043* (2015.01)

(58) Field of Classification Search
None
See application file for complete search history.

(56) References Cited

U.S. PATENT DOCUMENTS

| | | | |
|---|---|---|---|
| 2,181,391 | A | 11/1939 | Burgeson et al. |
| 2,253,012 | A | 8/1941 | Benner et al. |
| 4,676,521 | A | 6/1987 | Monreal |
| 4,974,868 | A | 12/1990 | Morris |
| 5,203,583 | A | 4/1993 | LeGrande et al. |

(Continued)

FOREIGN PATENT DOCUMENTS

| | | |
|---|---|---|
| WO | 9910053 | 3/1999 |
| WO | 9925433 | 5/1999 |
| WO | 20080137448 A1 | 11/2008 |

OTHER PUBLICATIONS

Snow.co.nz; 2005 Product Feature: INCA Snowboards; www.snow.co.nz/equipment/boards/inca.asp, downloaded Mar. 20, 2008.

(Continued)

*Primary Examiner* — James A Shriver, II
*Assistant Examiner* — Hilary L Johns
(74) *Attorney, Agent, or Firm* — Santangelo Law Offices, P.C.

(57) ABSTRACT

At least one embodiment of the inventive technology relates to a snowboard having three cambers, a first of which may be disposed immediately inboard of a first tip section, a second of which may be disposed immediately inboard of a second tip section, and a third of which may be centrally disposed between tip section termina of the snowboard, and between said first and second cambers. The third camber may be part of a centrally disposed rocker.

22 Claims, 8 Drawing Sheets

(56) References Cited

U.S. PATENT DOCUMENTS

| | | | |
|---|---|---|---|
| 5,275,428 | A | 1/1994 | Bejean et al. |
| 5,375,868 | A | 12/1994 | Sarver |
| 5,413,371 | A | 5/1995 | Trimble |
| 5,417,444 | A | 5/1995 | Chen |
| 5,462,304 | A | 10/1995 | Nyman |
| 5,538,272 | A | 7/1996 | Pearl |
| 5,556,123 | A | 9/1996 | Fournier |
| 5,573,264 | A | 11/1996 | Deville et al. |
| 5,667,238 | A | 9/1997 | Sarver |
| 5,695,209 | A | 12/1997 | Deborde et al. |
| 5,769,445 | A | 6/1998 | Morrow |
| 5,816,592 | A | 10/1998 | Horton et al. |
| 5,823,562 | A | 10/1998 | Stubblefield |
| 5,924,718 | A | 7/1999 | Gordon et al. |
| 5,927,734 | A | 7/1999 | Horton et al. |
| 5,954,356 | A | 9/1999 | Busby, Jr. et al. |
| 5,984,343 | A | 11/1999 | Longoni et al. |
| 6,352,268 | B1 | 3/2002 | Pearl |
| 6,382,658 | B1 | 5/2002 | Stubblefield |
| 6,394,483 | B2 | 5/2002 | Stubblefield |
| 6,481,741 | B1 | 11/2002 | Porte |
| 6,499,758 | B1 | 12/2002 | Fournier |
| 6,533,625 | B1 | 3/2003 | Taylor |
| 7,111,864 | B2 | 9/2006 | Moig |
| D529,565 | S | 10/2006 | Warmer et al. |
| 7,390,009 | B2 | 6/2008 | Trimble |
| 7,708,302 | B2 | 5/2010 | Wilson |
| 7,798,514 | B2 | 9/2010 | Canaday et al. |
| 7,823,892 | B2 | 11/2010 | Olson et al. |
| 8,029,013 | B2 | 10/2011 | Canaday et al. |
| 8,371,604 | B1 | 2/2013 | Soucy |
| 8,511,704 | B2 | 8/2013 | Olson et al. |
| 2001/0052679 | A1 | 12/2001 | Stubblefield |
| 2006/0091645 | A1 | 5/2006 | Cobb et al. |
| 2006/0226613 | A1 | 10/2006 | Wilson |
| 2008/0272575 | A1 | 11/2008 | Olson et al. |

OTHER PUBLICATIONS

INCA Snowboards/Roy Turner Ski Shop; www.snowzone.co.nz/inca; downloaded Mar. 20, 2008.

http://www.futuresnowboarding.com/2008/01/techno-file-rock-on; Future Snowboarding Magazine, Techno-File: Rock On blog; post by James Jan. 25, 2008.

http:/llib-tech.com/banana/index.html; Lib-Tech Banana Technology Web Page; the Lib Tech Experimental Division; Magne-Traction article.

http://lib-tech.com/snowboards/skatebanana.html; New Banana Technology; Skate Banana with Magne-Traction Web Page.

Lib Technologies 08-09 Catalog; Twin Pow Banana Hammock page.

1983 Model Pro Skiboard Catalog for Sims Designs, published 1983.

Snowboard Journal, vol. 1, No. 1, Winter 2004, pp. 22-29.

Affidavit of Ernie DeLost, executed on Apr. 28, 2009, relative to U.S. Appl. No. 11/744,509.

Snowpress, SIA 2007, Snowsports Trade Show, Day 3.

Snowpress, SIA 2008, Snowsports Trade Show, Day 3.

Letter to attorney for assignee regarding U.S. Appl. No. 12/888,227.

Photograph of snowboard housed in a display case at Mervin Manufacturing's booth at the 2012 SIA Snow Show, held from Jan. 26, 2012 to Jan. 29, 2012 at the Colorado Convention Center in Denver, Colorado.

Hooger Booger Blaster, Snowboardmuseum.de, 1992.

File wrapper from priority case: U.S. Appl. No. 12/100,974, entitled Cambered Snowboard, filed Sep. 8, 2010.

File wrapper from priority case: U.S. Appl. No. 12/877,864; entitled Cambered Snowboard, filed Sep. 8, 2010.

File wrapper from priority case: U.S. Appl. No. 13/246,588; entitled Snowboard Manufacturing Method, filed Sep. 27, 2011.

CAMBERED SNOWBOARD

This application is a continuation of, and claims priority to, U.S. application Ser. No. 13/623,776, filed Sep. 20, 2012 and issuing on Jun. 2, 2015 as U.S. Pat. No. 9,044,664, which itself is a continuation-in-part application that claims priority to U.S. Non Provisional application Ser. No. 13/246,588 filed Sep. 27, 2011 (published as Publication No. US-2012-0031546-A1, on Feb. 9, 2012) which itself is a continuation of, and claims benefit of and priority to U.S. Non Provisional application Ser. No. 12/877,864, filed Sep. 8, 2010 (published as Publication No. US-2011-0001306-A1, on Jan. 6, 2011 and issued as U.S. Pat. No. 8,029,013 on Oct. 4, 2011), said application itself being a continuation of, and claiming benefit of and priority to U.S. Non Provisional application Ser. No. 12/100,974, filed Apr. 10, 2008 (published as Publication No. US-2009-0256333-A1, on Oct. 15, 2009 and issued as U.S. Pat. No. 7,798,514 on Sep. 21, 2010), each said patent and patent application hereby incorporated herein by reference in its entirety.

I. BACKGROUND

Snowboarding has boomed in popularity in the last 25 years or so. From its underground roots where the first few pioneering boarders were shunned from all but a few ski areas, to its wide acceptance at areas throughout the world, snowboarding truly is a study in transformation. And as certain less tangible aspects of the world of snowboarding—public perception, acceptance, demography of participants—have changed, so too have its more tangible aspects, including, most notably, board design. As boarders brought their craft into more challenging, demanding realms—backcountry, halfpipe, snowboard race courses, snowboard parks filled with rail slide objects, and even stair rails in city centers—board designs evolved. However, most board design efforts from the inception of snowboarding have focused most on board materials—the actual profiles of the lower surfaces of boards, although certainly changing over the years, have seen comparatively little design attention. The changes that have occurred include: (a) impartation of a camber from tip section to tip section; (b) impartation of a curved, reverse camber (or curved rocker) profile to the board along the entire length of the board (from tip section to tip section); and (c) in a different design, impartation of a curved rocker to an area from between a point under one mount region of a board to another point under the board's other mount region. The rocker designs have received considerable acceptance among the boarding community. Once boarders get used to the rocker, they like it; as compared with traditional "flat" board or boards with a centrally located single camber, it offers more maneuverability with a slicker, less constrained feel and a smoother sense of handling. It is without question a significant advancement in board profile design.

An industry observer might conclude that the rocker is the ultimate—and perhaps final—evolutionary mutation in snowboard design. After all, what's been called the "dual camber" board design had already been introduced (see U.S. Pat. No. 5,823,562 and PCT Publication No. WO 99/10053), and now with the two above-discussed rocker designs, one might think that there is no longer any room left to do anything to board profiles that would represent a performance improvement, even if only for a certain specialized ride (half pipe or racing, as but two examples). After all, one might think "how much can be done with the underside of a snowboard?" The inventors of the inventive technology disclosed in this disclosure asked this very question and, after experimental testing of their inventive design concept, have found a new and different design that offers significant advantages relative to all known types of boards.

II. SUMMARY OF THE INVENTION

At least one embodiment of the inventive technology relates to a snowboard having a lower surface that does not at any point along at least one specified portion thereof contact a horizontal surface underlying the snowboard when the snowboard is unweighted. Such portion(s) may be defined, at least in part, by one or more cambers. A rocker may be used to impart additional board performance benefits to a rider. Other embodiments may relate more specifically to the positioning of cambers relative to mount regions.

It is an object of at least one embodiment of the inventive technology to provide a snowboard where the board does not contact a horizontal surface underlying the board, from the outer end of at least one camber to the terminus of the tip section that is proximal such camber, when the board is unweighted (without bindings, boots and boarder).

It is an object of at least one embodiment of the inventive technology to provide a board that offers advantages of rockered designs without introducing riding difficulties that inhere in such conventional rocker designs, such as less stability in riding rail objects, and compromised control/spring action in executing maneuvers such as ollies or spins (as but two examples).

It is an object of at least one embodiment of the inventive technology to offer advantages of two cambers without also introducing the compromise of rider control and maneuverability that inhere in prior art designs having dual (or more) cambers. Such prior art designs may restrict a rider's ability to work the spring action of the board in executing certain maneuvers such as ollies, and compromise board responsiveness, and smoothness of ride. Further, although prior art dual camber designs offer some riding advantages in certain situations, their particular design simply does not allow a rider as enjoyable, free-feeling, responsive and, simply, fun, easy-spinning ride as could be possible for a board featuring a double camber.

It is an object of at least one embodiment of the inventive technology to provide a double cambered snowboard that offers riding and performance enhancements not found in prior art dual cambered boards, such as improved stability during rail rides/slides, slicker feel, more responsive performance, less constrained ride, easier spinning, and enhanced/easier recruitment of a boards spring action during execution of tricks such as a ollie, as but a few examples.

It is an object of at least one embodiment of the inventive technology to provide a board featuring a rocker and dual cambers that are relatively configured to preclude performance problems such as compromise of board responsiveness, constrained rider feel, and relatively poor handling in "crud" (as but a few examples) and enhance performance by providing a more easily maneuverable board, improving performance in less than optimal snow conditions, and making riding of rails easier and more stable (as but a few examples).

III. BRIEF DESCRIPTION OF THE DRAWINGS

FIG. 1A shows an embodiment of an unweighted bi-directional snowboard having a curved rocker and curved cambers. Generally, in this and in all FIGS. 1-19, the lower outline of the closed curve (the lower half of the closed curve would be the lower outline; the upper half of the closed curve is the upper outline) shown for each of FIGS. 1-19 corresponds with the lower surface of the board; the upper outline, the upper surface of the board. The shape of the lower surface is, of course, represented by the lower outline of the closed curve of each of FIGS. 1-19 and is the profile that is a focal point of many embodiments of the inventive technology.

IV. DETAILED DESCRIPTION OF THE INVENTIVE TECHNOLOGY

As mentioned earlier, the present invention includes a variety of aspects, which may be combined in different ways. The following descriptions are provided to list elements and describe some of the embodiments of the present invention. These elements are listed with initial embodiments, however it should be understood that they may be combined in any manner and in any number to create additional embodiments. The variously described examples and preferred embodiments should not be construed to limit the present invention to only the explicitly described systems, techniques, and applications. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

Figure 1A:
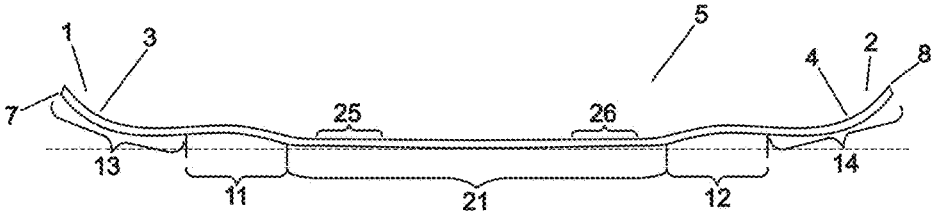
FIG. 1B shows an embodiment of a weighted bi-directional snowboard having a curved rocker and curved cambers. It also serves to show a profile of certain unweighted "camber position" embodiments.
Figure 1B:
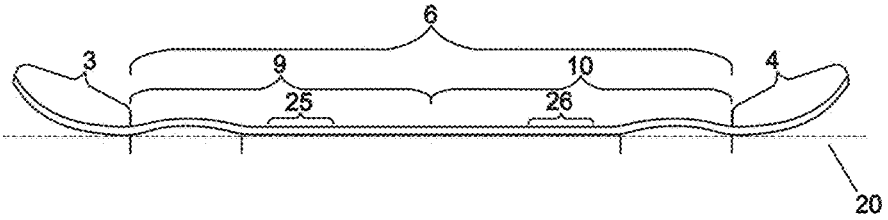
Figure 2A:
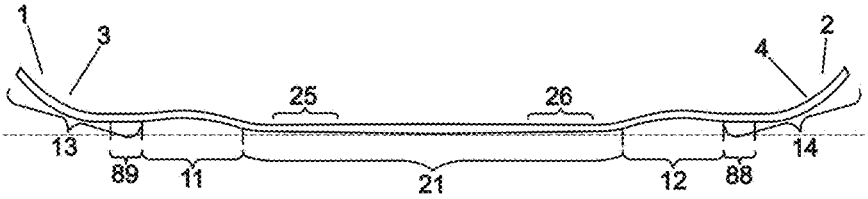
FIG. 2A shows an embodiment of an unweighted bi-directional snowboard having a curved rocker and curved cambers and a horizontal flat section 89, 88 between each camber and each tip section.
Figure 2B:
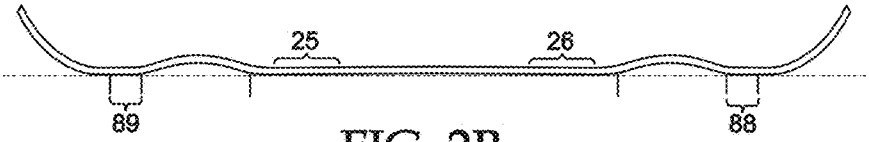
FIG. 2B shows an embodiment of a weighted bi-directional snowboard having a curved rocker and curved cambers and a flat section 88, 89 between each camber and each tip section. It also serves to show a profile of certain unweighted "camber position" embodiments.
Figure 3:
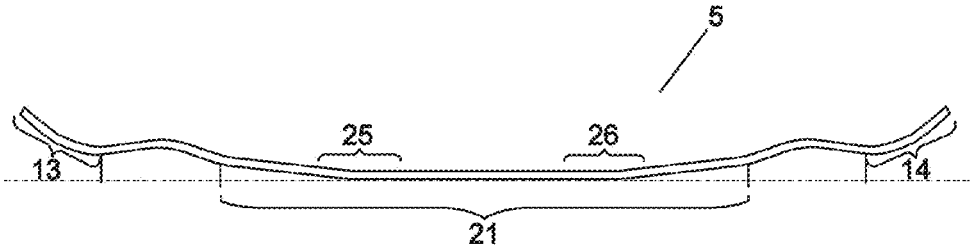
FIG. 3 shows an embodiment of an unweighted bi-directional snowboard having curved cambers and a rocker with straight sections.
Figure 4:
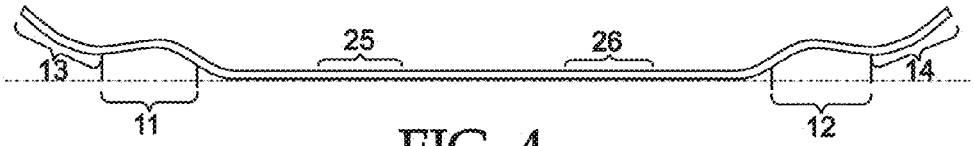
FIG. 4 shows an embodiment of an unweighted bi-directional snowboard having curved cambers and a rocker with a central straight section and outer curved sections.
Figure 5:
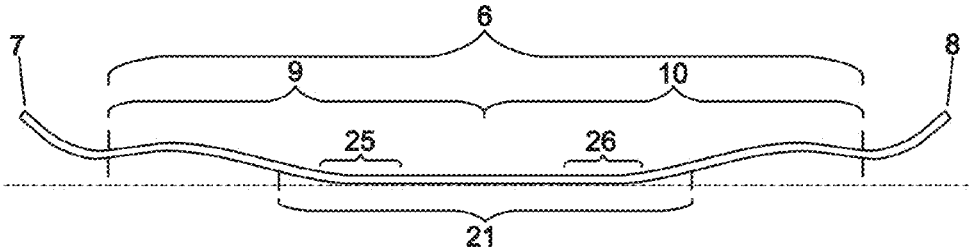
FIG. 5 shows an embodiment of an unweighted bi-directional snowboard having curved cambers and a rocker with a central straight section and outer curved sections.
Figure 6:
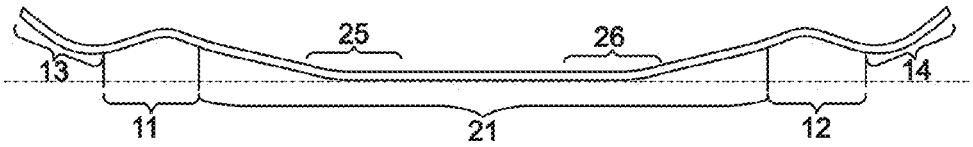
FIG. 6 shows an embodiment of an unweighted bi-directional snowboard having curved cambers and a rocker with curved and straight sections.
Figure 7:
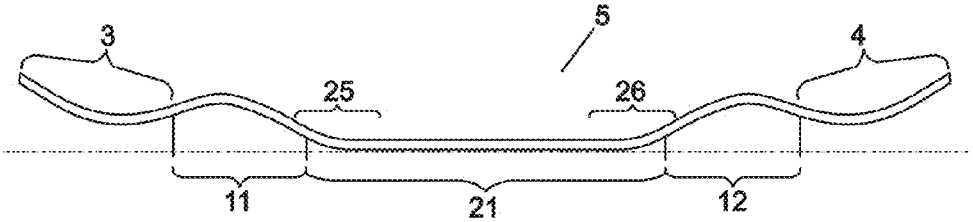
FIG. 7 shows an embodiment of an unweighted bi-directional snowboard having cambers with straight and curved sections and a rocker with a straight section and curved sections.
Figure 8A:
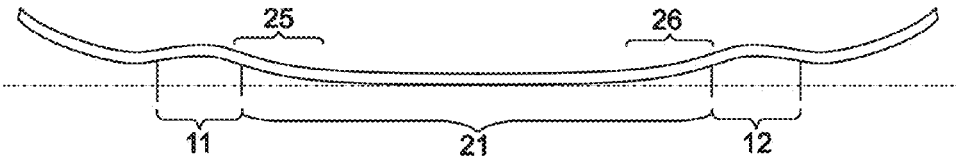
FIG. 8A shows an embodiment of an unweighted bi-directional snowboard having curved cambers and a curved rocker.
Figure 8B:
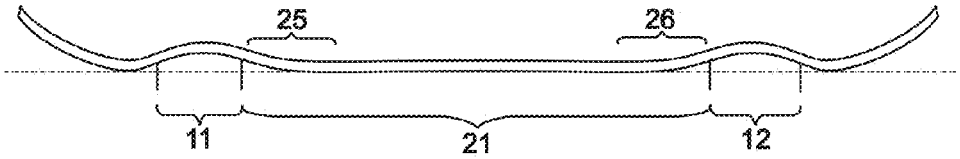
FIG. 8B shows an embodiment of a weighted bi-directional snowboard having curved cambers and a curved rocker. It also serves to show a profile of certain unweighted "camber position" embodiments.
Figure 9:
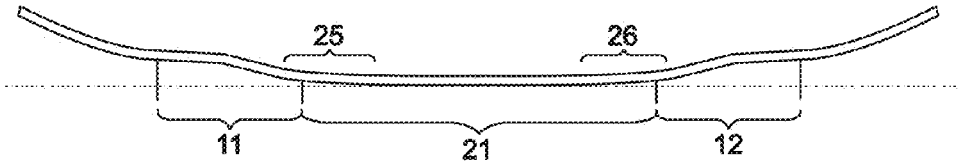
FIG. 9 shows an embodiment of an unweighted bi-directional snowboard having cambers with straight sections and a curved rocker.
Figure 10A:
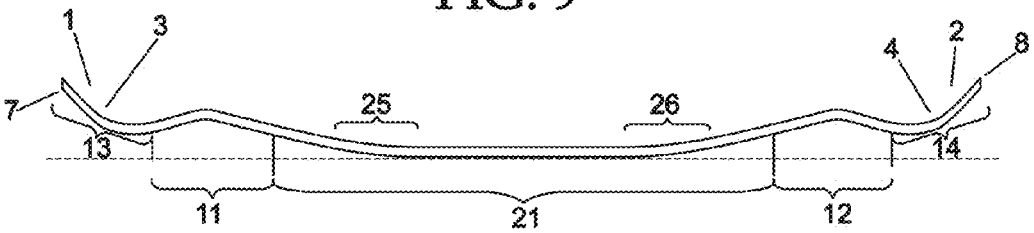
FIG. 10A shows an embodiment of an unweighted bi-directional snowboard having cambers with a curved and straight section and a rocker with curved and straight sections.
Figure 10B:
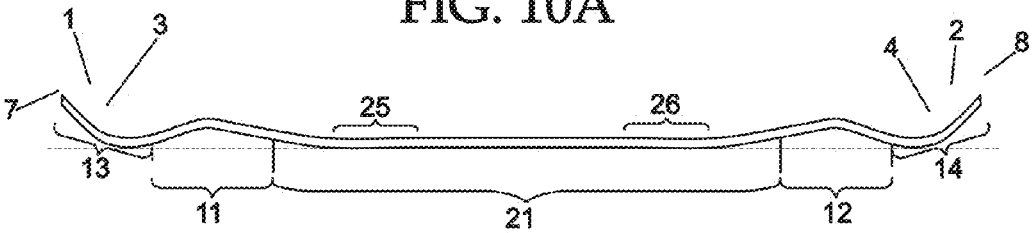
FIG. 10B shows an embodiment of a weighted bi-directional snowboard having cambers with a curved and straight section and a rocker with curved and straight sections. It also serves to show a profile of certain unweighted "camber position" embodiments.
Figure 11:
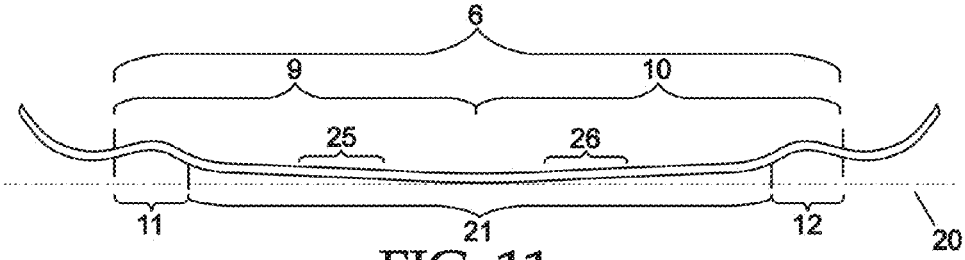
FIG. 11 shows an embodiment of an unweighted bi-directional snowboard having curved cambers and a rocker with a curved section and a straight section.
Figure 12:
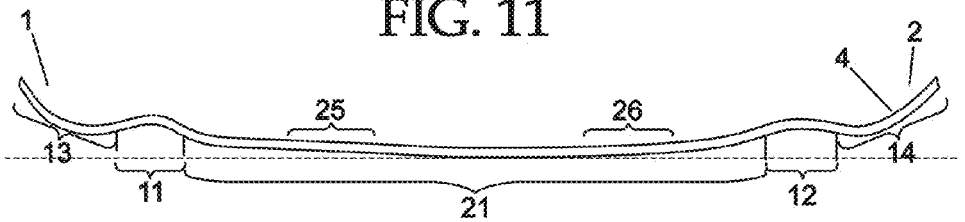
FIG. 12 shows an embodiment of an unweighted bi-directional snowboard that is asymmetric about an axis that is orthogonal to a board's travel direction and that is located halfway along the length of the board.
Figure 13A:
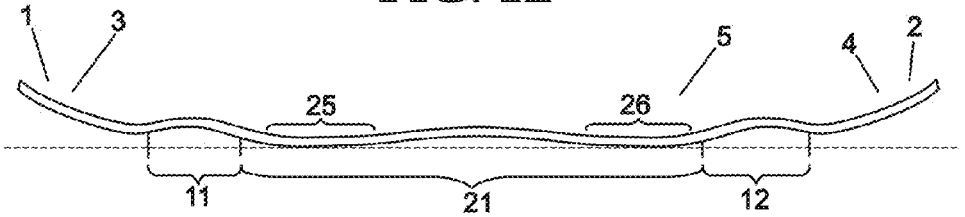
FIG. 13A shows an embodiment of an unweighted bi-directional snowboard having a curved rocker and three curved cambers, one of which is centralized and part of the rocker.
Figure 13B:
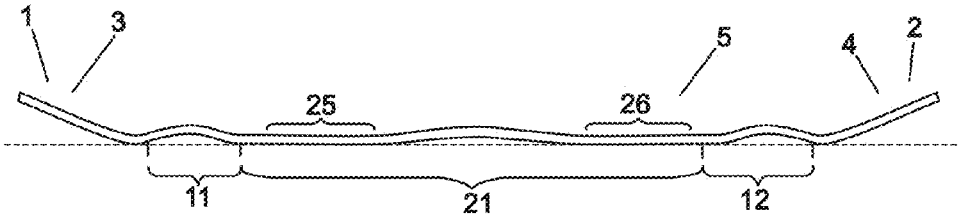
FIG. 13B shows an embodiment of a weighted bi-directional snowboard having a curved rocker and three curved cambers, one of which is centralized and part of the rocker.
Figure 14:
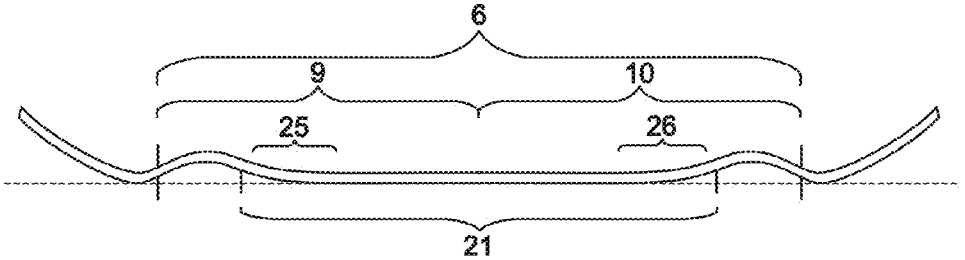
FIG. 14 shows an embodiment of an unweighted bi-directional snowboard having curved cambers and a curved rocker.
Figure 15A:
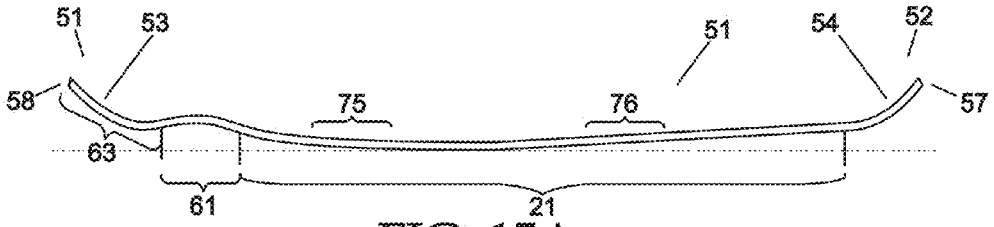
FIG. 15A shows an embodiment of an unweighted directional snowboard having a rocker that is curved in the rear and mostly straight at the front, and a curved rear camber.
Figure 15B:
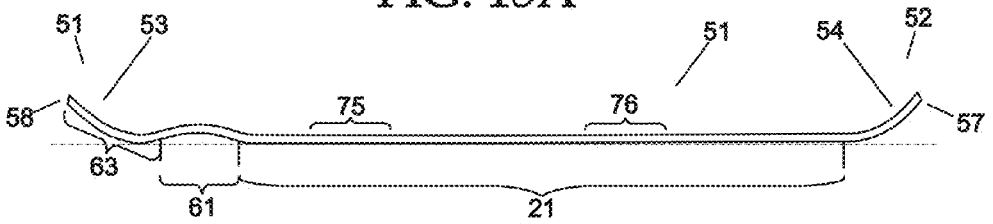
FIG. 15B shows an embodiment of a weighted directional snowboard having a rocker that is curved in the rear and straight at a substantial portion of its front, and a curved rear camber.
Figure 16:
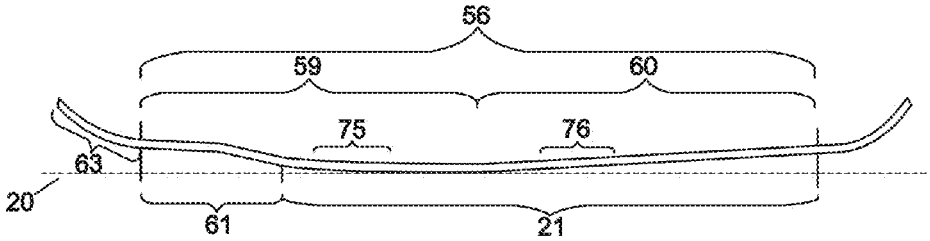
FIG. 16 shows an embodiment of an unweighted directional snowboard having a rocker that is curved in the rear and straight a substantial portion of its front, and a rear camber having straight sections.
Figure 17A:
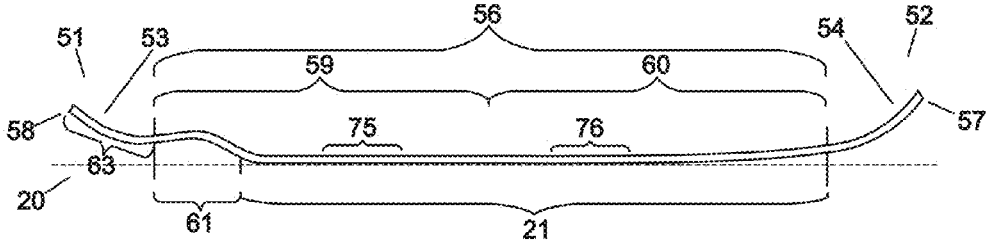
FIG. 17A shows an embodiment of an unweighted directional snowboard having a rocker substantially with a curved and straight section, and a curved rear camber.
Figure 17B:
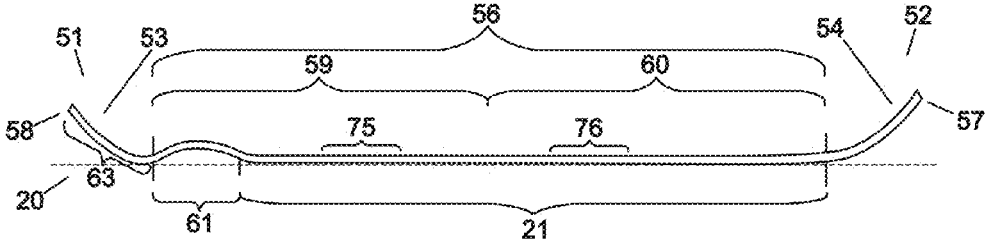
FIG. 17B shows an embodiment of a weighted directional snowboard having a rocker substantially with a curved and straight section, and a curved rear camber.

At least one embodiment of the inventive technology, particularly as it relates to bi-directional snowboards, is a snowboard 5 that comprises a first tip section 3 at a first end 1 of the snowboard and a second tip section 4 at a second end 2 of the snowboard; and an intermediate longitudinal section 6 between the first and second tip sections, where the first tip section has a first tip section terminus 7 and the second tip section has a second tip section terminus 8, where the intermediate longitudinal section includes a first intermediate section half 9 in contact with the first tip section and a second intermediate section half 10 in contact with the second tip section, where at least a part of the first intermediate section half has a lower surface that defines a first camber 11 and at least a part of the second intermediate section half has a lower surface that defines a second camber 12, where the first camber has two first camber ends and one of the first camber ends is closer to the first tip section than is the other of the first camber ends, where the second camber has two second camber ends and one of the second camber ends is closer to the second tip section than is the other of the second camber ends, and where at least one of: a first snowboard portion 13 from and including the first tip section terminus to and including the one of the first camber ends that is closer to the first tip section; and a second snowboard portion 14 from and including the second tip section terminus to and including the one of the second camber ends that is closer to the second tip section, does not at any point contact a horizontal surface 20 underlying the snowboard when the snowboard is unweighted. The area between the two cambers may be any of a variety of shapes, whether rocker, non-rocker, camber, non-camber, flat and horizontal, and a combination of any two or more of such shapes, as but a few examples. FIGS. 13A and 13B show a central, third camber that is part of a rocker (note that in designs with a central, third camber, such camber can be part of a rocker or, in an alternate design with no rocker, not form part of a rocker at all). As used herein, the term snowboard includes boards even where they have no inserts or mount hardware. It is also of note that FIGS. 1B and 7 point out with particularity the first tip section 3 and the second tip section 4; for reasons relative to clarity of presentation, certain other of the figures that point out such sections only generally point to the respective section. Figures that comport with the above description include FIGS. 1-15 (where the A versions show unweighted profiles and the B versions show weighted profiles).

At least one directional snowboard embodiment may comprise a rear tip section 53 at a rear end 51 of the directional snowboard and a front tip section 54 at a front end 52 of the directional snowboard; and an intermediate longitudinal section 56 between the rear and front tip sections, where the rear tip section has a rear tip section terminus 57 and the front tip section has a front tip section terminus 58, where the intermediate longitudinal section includes a rear intermediate section half 59 in contact with the rear tip section and a front intermediate section half 60 in contact with the front tip section, where at least a part of the rear intermediate section half has a lower surface that defines a rear camber 61, where the rear camber has two rear camber ends and one of the rear camber ends is closer to the rear tip section than is the other of the rear camber ends, and where a rear snowboard portion 63 from and including the rear tip section terminus to and including the one of the rear camber ends that is closer to the rear tip section does not at any point contact a horizontal surface 20 underlying the directional snowboard when the directional snowboard is unweighted. Of course, a first snowboard part that is closer to one snowboard section than is a second snowboard part may adjoin (be in contact with; abut) such snowboard section, although it need not. Figures that comport with the above description include FIGS. 15-19.

The aforementioned features—(a) where at least one of: a first snowboard portion from and including the first tip section terminus to and including the one of the first camber ends that is closer to the first tip section; and a second snowboard portion from and including the second tip section terminus to and including the one of the second camber ends that is closer to the second tip section, does not at any point contact a horizontal surface underlying the snowboard when the snowboard is unweighted; and, as more specifically relates to directional snowboards (b) where a rear snowboard portion from and including the rear tip section terminus to and including the one of the rear camber ends that is closer to the rear tip section does not at any point contact a horizontal surface underlying the directional snowboard when the directional snowboard is unweighted—each provides significant board performance benefits. Such benefits may include, but are not necessarily limited to: better control in certain conditions (e.g., powder, groomed and/or chunky or crud snow conditions), greater maneuverability, less constrained riding feel, improved tendency of the board to float over/around obstacles (where the non-contacting portion of the board is a "leading" portion) and, particularly in those designs with a rocker, not disturbing the "rockability" of the board, thereby affording rocker benefits and optimizing camber benefits in one design.

In particular embodiments of those designs with what are called first 13 and second snowboard portions 14, both the first snowboard portion and the second snowboard portion do not at any point contact the horizontal surface underlying the snowboard when the snowboard is unweighted. It is also of note that in certain designs the intermediate longitudinal section has a non-camber section between the first camber and the second camber. In particular directional board embodiments, the intermediate longitudinal section may have a non-camber section between the rear camber and the front tip section. Such non-camber section (whether it's on a directional or bi-directional board) may take a variety of shapes—it may be a flat horizontal section; it may be a rocker 21 (whether curved, V-shaped, or includes a flat horizontal section between two non-horizontal sections, as but a few examples). In those designs with a rocker that includes a flat horizontal section between two non-horizontal sections, the two non-horizontal sections may each be flat and angled upwards, or the two non-horizontal sections may be each curved upwards (as but two of many possible designs).

In particular embodiments, the board may assume a certain shape when weighted by a 150 lb. boarder mounted on the snowboard. For example, in those designs with what are referred to as first and second snowboard portions 13, 14, at least one point of either or each the first and second snowboard portions may contact the horizontal surface underlying the snowboard when so weighted. In at least one embodiment of a directional board, at least one point of the rear snowboard portion contacts the horizontal surface underlying the directional snowboard when a 150 lb. boarder is mounted on the directional snowboard.

In any design, cambers (whether rear, front, first or second) may take a variety of shapes—either or both may be curved, have an upside-down V-shape, have an intermediate flat section between two curved sections, have an intermediate flat section between two downwardly angled flat sections, as but a few examples. Of course, cambers of a board need not be identical in shape, nor equally spaced from the longitudinal center of the board, although they certainly may be.

The rocker is that part of a snowboard's lower surface that allows a mounted rider to rock back and forth about an axis that is orthogonal to the longitudinal axis of the board and between the outer ends of the mount regions, when the board is on a rigid horizontal surface. In particular embodiments, the rocker establishes a profile (of course, the term profile as used in this specification refers to the outline of the lower surface of the board as viewed from the side of the board) that is between two points on the snowboard's lower surface, where such two points are not in contact with a horizontal underlying surface when the snowboard is unweighted, but are within the outer edges of the board mount region, where, typically, at least one intermediate point between such two points contacts such underlying surface when the snowboard is unweighted. As such, a rocker may be a curved reverse camber, a V-shaped profile section, an intermediate flat section (where flat as used herein does not necessarily mean horizontal, but merely means straight and not curving) between two curved reverse cambers, an intermediate flat section between two upwardly angled flat sections, as but a few examples, or a combination of two or more of such shapes (as but a few of many examples). A rocker has a "concave up" shape, although, as explained, it need not be entirely curved (nor curved at all). Often, particularly with bi-directional boards, the rocker axis is through the substantial longitudinal center of the board (although, of course, this is not a required feature).

In most embodiments, a rocker does not include a camber as a sectional part thereof (although in certain other embodiments it may). By definition, and merely for reasons relative to clarity of understanding of the description, no part of the rocker is part of either tip section of the snowboard (even though one might rock up on the tip section). A rocker typically has two ends—one rocker end that is closer to a first tip section or, with directional boards, a rear tip section, of the snowboard than is the other rocker end, and another rocker end that is closer to a second tip section.

It is of note that, as used herein, the horizontal surface underlying the snowboard is rigid and strong enough not to deform under the weight of a 150 lb. boarder and the snowboard itself. It is of further note that the tip section is the part at either end of the board that extends from its tip terminus towards (in the direction of) the middle section of the board, to the part that is not a tip section (e.g., a camber, as but one example).

A camber may include a curved camber (perhaps forming an arch), an upside down V-shaped profile section (e.g., flat sections downwardly angled from a center point), an intermediate flat section between two curved cambers, an intermediate flat section between two downwardly angled flat sections, as but a few examples, or a combination of two or more of such shapes. Typically, a camber has a "concave down" shape, although, as explained, it need not be entirely curved (or even curved in any portion whatsoever). In preferred embodiments, a camber does not include a rocker section and part of the camber is not part of either tip section of the snowboard. A camber typically has two ends—one camber end that is closer to a first tip section of the snowboard (perhaps it even contacts and abuts such tip section) than is the other camber end.

A camber may enhance a rider's ability to obtain and maintain a stable board position relative to, for example, a rail obstacle when it's being ridden; a camber may enhance the spring feel and force of a board while a rider/boarder is executing an "ollie" or other boarding maneuvers that use the spring action of a board. In most instances, a camber may be that portion of a board's lower surface which contains therein a relative peak or relatively highest mesa. The term relative (and relatively) are used because, as a camber is often "canted" (tilted, as is the case where ends of the camber are not at the same elevation off an underlying horizontal surface), a relative peak or relatively highest mesa is that peak or mesa (defined as a camber apex) that is the greatest distance above an imaginary surface established between the ends of the camber (such surface would be non-horizontal where the camber is canted). It is of note that the term "between" does not require that the thing between the two other parts/items/locations contact with either or both of the two other parts/items/locations (although indeed there may be such contact).

A non-camber section is any section that does not fall within the definition of camber and includes, but is not necessarily limited to, a rocker and a flat section. Of incidental note is that a flat section, in isolation, is a non-camber section (although indeed a flat section may be part of a camber). It is also of note that, in following the conventional use of the terms camber and reverse camber, camber (i.e., without being immediately preceded by the adjective "reverse") is mutually exclusive of, and does not include, reverse camber.

In those designs with a rocker established between two cambers, the cambers are not necessarily immediately adjacent (in contact with; adjoining) the rocker (for example, there may be a flat, horizontal section between the rocker and the two cambers), although they certainly may be. In those designs where a camber is in contact with a curved portion of a non-camber section (e.g., a rocker or a tip section), and where the camber is smoothly curved at such transition, the precise point where the profile transitions from non-camber to camber (or vice versa) may be the mathematical inflection point of the curve. As is well known, the inflection point is the point at which the rate of change of slope of the profile curve is zero (where the curve, y, is graphed as a function of the horizontal distance, x, from a point on a horizontal surface underlying the snowboard). In designs where a camber adjoins a rocker or tip section, typically the camber can often be distinguished from the rocker by determining at which point on the profile the profile transitions from concave up (rocker, also known as reverse camber in the industry) to concave down (camber). As a camber can have any of an infinite number of shapes (whether curved alone, or curved and straight, and/or even stepped in parts), and as a non-camber part (e.g., a rocker or tip section) can have any of a infinite number of shapes (whether curved alone, or curved and straight, and/or even stepped in parts), in certain designs, particularly where the camber and the non-camber sections do not adjoin in smoothly curving fashion, the point at which one transitions to the other (e.g., rocker to camber or tip section to camber) can be the point at which the profile changes shape (e.g., from a curve to a straight line, from a straight line having one angle to a straight line having a different angle, at two curves that meet at a point of discontinuity (e.g., form a relatively sharp apex or point)), and where, perhaps only intuitively, that point separates concave up from concave down portions of the profile. In certain less preferred embodiments where a straight, upwardly angled profile inclines upwards (in a direction outward from the center of the board) and then transitions in a more downward direction (including at a less steep angle) when proceeding in a direction towards the tip section, as part of the camber (whether it proceeds more downward in straight or curved fashion), the point at which the camber starts and the rocker ends may be deemed to be at a point one-half the distance along the aforementioned straight, upwardly angled profile (see, e.g., FIG. 10).

In designs where the tip section is in contact with (adjoins) a camber (this is often, but not always, the case), the precise location at which the tip section starts is the point at which the camber ends, as defined above (e.g., an inflection point if the two adjoin in a smoothly curving manner). When the tip section does not adjoin a camber (e.g., where it adjoins a flat section, e.g. 88, 89 of FIGS. 2A and 2B), the tip section may be said to start at the tip-proximal end of the non-camber section that it adjoins (e.g., at the end of a flat section 88, 89, as in FIGS. 2A and 2B). As such, as is readily apparent from, e.g., FIG. 10, the tip sections, at least in the unweighted profile, may appear to include more of the board (i.e., be larger) than they might conventionally be considered to include (tip sections that extend beyond the tip section's relative low point towards the center of the board, terminating at the respective camber's start). When the board is weighted, the start of the tip section may be more consistent with or closer to what a boarder stopped on the snow would identify as the tip section—where the end of the board starts to more sharply turn upwards. It is of note that the tip section need not always be curved; indeed, in certain embodiments, it may be partially or entirely flat (e.g., upwardly inclined, non-horizontally flat).

Particular embodiments may also relate to the positioning of certain parts/points of the board's profile relative to other parts of the board. In at least one embodiment of those designs having a first intermediate section half 9 and a second intermediate section half 10, the first intermediate section half may include a first mount region 25 (e.g., the longitudinal portion on the board where the first set of inserts are located) and the second intermediate section half includes a second mount region 26 (e.g., the longitudinal portion on the board where the second set of inserts are located). In those embodiments with what are referred to as first camber ends, one of the first camber ends is closer to the second tip section than is the other of the first camber ends. In certain inventive designs, the one of the first camber ends that is closer to the second tip section than is the other of the first camber ends may be established within the first mount region. In other designs, it may be established between the first mount region and the first tip section. In those embodiments with what are referred to as second camber ends, one is closer to the first tip section than is the other. In certain inventive designs, the one of the second camber ends that is closer to the first tip section than is the other of the second camber ends may be established within the second mount region. In other designs, it may be established between the second mount region and the second tip section. It is of note that mount regions (whether first, second, front or rear) exist even where no inserts have been drilled or other mount hardware exists—in such situations, the mount region is simply that longitudinal portion where the inserts or other mount hardware would/will be located.

In directional board embodiments, the rear intermediate section half includes a rear mount region 75 and the front intermediate section half includes a front mount region 76 and one of the rear camber ends is closer to the front tip section than is the other of the rear camber ends. In particular directional the one of the rear camber ends that is closer to the front tip section is established within the rear mount region while in other particular embodiments the one of the rear camber ends that is closer to the front tip section is established between the rear mount region and the rear tip section.

In those embodiments with first and second tip sections and first and second cambers, certain designs may include a first flat section 89 between the first tip section and the first camber and/or a second flat section 88 between the second tip section and the second camber (or possibly in other areas). In certain directional board embodiments, there may be a rear flat section between the rear tip section and the rear camber (or possibly in other areas). However, these features, as with all features not listed in an independent claim (as originally presented this application) that describes a specific inventive design, may be entirely optional in designs reflecting that specific design feature.

Certain design features may relate to weighted profile response of camber apices of the board profile. In those embodiments with first and second cambers, the first camber has a first camber apex and the second camber has a second camber apex. In particular embodiments, the first camber apex and the second camber apex each do not contact the horizontal surface underlying the snowboard when a 150 lb. boarder is mounted on the snowboard. In certain directional board embodiments, the rear camber has a rear camber apex that does not contact the horizontal surface underlying the directional snowboard when a 150 lb. boarder is mounted on it. It is of note that in some embodiments, it's theoretically impossible to flatten either camber (such that its apex hits the ground) when the board is weighted, no matter how much weight is applied.

In embodiments with what are called first and second tip sections, such first and/or second tip sections is what boarders conventionally refer to as a kick (which, as defined herein, is always curved along its entire length). In directional boards, the rear tip section may be a kick and or the front tip section may be a kick.

As one can appreciate, although each bi-directional boards and directional boards may be symmetric or asymmetric when they come off the factory line (relative to a central axis that is orthogonal to an intended boarding direction, and before any inserts or sliders are formed), typically the directional board is more likely to be asymmetric than is the bi-directional board. Regardless of whether a directional board is symmetric or not, in certain direction board embodiments, the front intermediate section half may comprise at least part of a rocker and/or the front intermediate section half may comprise a flat section (as but two examples). Of course, so too may the rear half. However, in many, but certainly not all directional board embodiments, there is only one camber, and it is a rear camber. As such, it may be the case that there are more asymmetric directional board embodiments than there are asymmetric bi-directional board embodiments. This should be as one would expect, as certain riders, particularly directional boarders who do not ride rails, might only want a camber for the added spring action it offers to one of boarders' most favorite tricks—the rear ollie—and the rear ollie requires spring action from the rear of the board only. Again, asymmetric directional board designs may, but need not, have a front intermediate section half that, unlike the rear half, does not have a camber. Often, the front intermediate section half of an asymmetric directional board design will include a front portion of a rocker and a front tip section (perhaps among other features).

It is also of note that a first or second, or rear or front intermediate section half need not be symmetric with the other half; the term half does not necessarily imply that the halves are symmetric, whether mirror or otherwise, although such halves can be, as an intermediate section half merely extends to the measured longitudinal middle of the board (tip to tip) from respective tip sections. Additionally, every bi-directional snowboard has a first and second intermediate section half (directional boards have a rear and a front intermediate section half). Of course, as is clear, such intermediate section halves may each have an end at the start of a proximal tip section (in this instance, meaning the end of the tip section that is towards the longitudinal middle of the board).

It is of note that bi-directional boards often do not have an identifiable front or rear when they come off the factory floor, as they are often, at that point, without mount hardware (e.g., inserts, sliders, mount hardware). As such, the specification uses the terms first and second (where first may refer to on one half of the board and second refers to the other half of the board). It may indeed turn out that the first specific part of an individual board is the rear part of that board (or the front part) after bindings are attached (and, indeed, even some setback insert patterns may by themselves impose a front and back on a board), but when that bi-directional board comes off the factory line, and before inserts are drilled, it does not have a front or rear. Even as to those boards that, for one reason or another, do have an identifiable front and back, the terms first and second can, at times, apply to adequately describe their various parts.

In any embodiment, the snowboard may be an all-mountain/free ride board, a freestyle board, and/or an alpine board. The snowboard may be a split board; it may be bi-directional, or directional (note that in those embodiments specifying front and rear parts of the board or its profile, such board is typically a directional board).

A particular independent inventive aspect of the inventive technology (which, for clarity reasons, may be referred to as "camber position" technology) may relate to a snowboard that comprises a first tip section 3 at a first end 1 of the snowboard and a second tip section 4 at a second end 2 of the snowboard; and an intermediate longitudinal section 6 between the first and second tip sections, where the intermediate longitudinal section includes a first intermediate section half 9 in contact with the first tip section and a second intermediate section half 10 in contact with the second tip section, the snowboard further comprising: a first camber 11 defined by a lower surface of at least a part of the first intermediate section half; and a second camber 12 defined by a lower surface of at least a part of the second intermediate section half, a rocker 21 established between the first camber and the second camber; where the first intermediate section half includes a first mount region 25 and the second intermediate section half includes a second mount region 26, where the first camber has two first camber ends and the second camber has two second camber ends, where one of the first camber ends is closer to the second tip section than is the other of the first camber ends and the one of the first camber ends that is closer to the second tip section is established between the first mount region and the first tip section, and where one of the second camber ends is closer to the first tip section than is the other of the second camber ends and the one of the second camber ends that is closer to the first tip section is established between the second mount region and the second tip section. It is of note, as a point of clarification, that any indication herein that a certain feature may be reflected in the "camber position" design does not in any manner suggest that such feature cannot appear in other designs. It is further of note that the broad embodiments of the inventive "camber position" technology, as described in this paragraph, do not require that a certain portion(s) of the board not touch a horizontal surface underlying the board when the board is unweighted (although indeed certain embodiments of the inventive "camber position" technology may reflect such feature). Indeed, certain of the weighted profile figures (which meet the description provided above in this paragraph) such as FIGS. 1B, 2B, 8B, and 10B may be considered to show an unweighted "camber position" embodiment. Of course, the rocker shown in such figures, in their capacity as showing an unweighted camber position embodiment, is only exemplary and one of many rockers that could be used; any other rockers (e.g., entirely curved rockers) could be used, and certainly be more pronounced than shown in any of FIGS. 1B, 2B, 8B and 10B. Notwithstanding that certain "B" figures show both weighted and unweighted profiles, the "A" versions of such figures can also be viewed as showing certain unweighted "camber position" embodiments.

In particular embodiments of the "camber position" technology (and, indeed, other inventive technologies), at least one of: (a) a first snowboard portion 13 from and including the first tip section terminus to and including the one of the first camber ends that is closer to the first tip section than is the other of the first camber ends; and (b) a second snowboard portion 14 from and including the second tip section terminus to and including the one of the second camber ends that is closer to the second tip section than is the other of the second camber ends does not at any point contact a horizontal surface underlying the snowboard when the snowboard is unweighted. It is also of note that when certain embodiments are weighted (e.g., by a 150 lb. boarder), at least one point of each the first snowboard portion and the second snowboard portion contacts the horizontal surface underlying the snowboard.

In particular of the "camber position" embodiments (and indeed certain embodiments of the other inventive board design technologies), one of the first camber ends that is closer to the second tip section does not contact a horizontal surface underlying the snowboard when the snowboard is unweighted, and/or one of the second camber ends that is closer to the first tip section does not contact a horizontal surface underlying the snowboard when the snowboard is unweighted. In particular embodiments, the one of the first camber ends that is closer to the second tip section contacts the horizontal surface underlying the snowboard when a 150 lb. boarder is mounted on the snowboard and/or the one of the second camber ends that is closer to the first tip section contacts the horizontal surface underlying the snowboard, when a 150 lb. boarder is mounted on the snowboard. It is of note that in some embodiments, it's theoretically impossible to flatten the camber (such that its apex hits the ground) when the board is weighted, no matter how much weight is applied.

The rocker 21 of the "camber position" embodiments may take the shape as described relative to other aspects of the inventive technology. Indeed, features described elsewhere in this patent application may be reflected in the camber position embodiments and, as mentioned, vice versa.

Figure 18A:
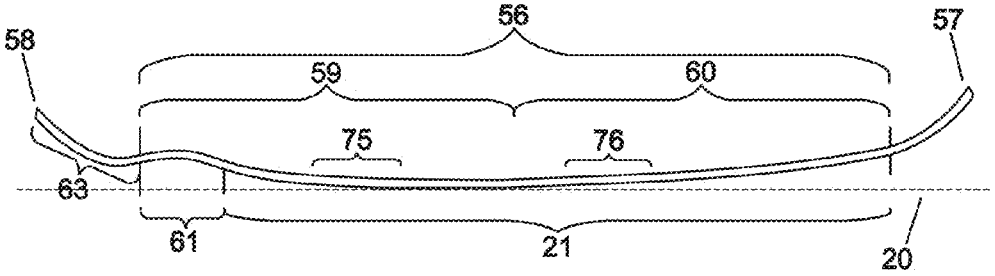
FIG. 18A shows an embodiment of an unweighted bi-directional directional snowboard having a curved rocker and a curved rear camber.
Figure 18B:
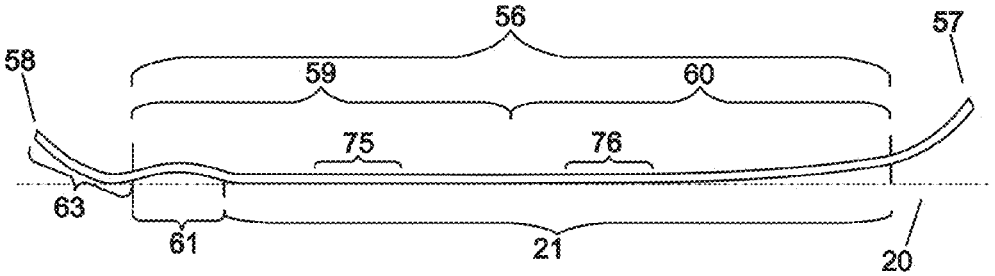
FIG. 18B shows an embodiment of a weighted bi-directional directional snowboard having a curved rocker and a curved rear camber. It also serves to show a profile of certain unweighted "camber position" embodiments.
Figure 19:
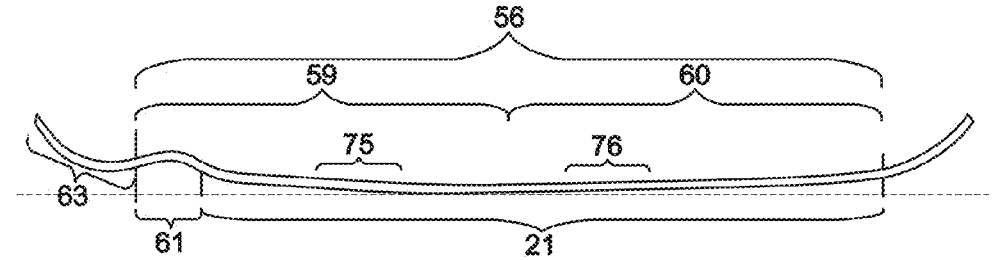
FIG. 19 shows an embodiment of an unweighted bi-directional directional snowboard having a curved rocker and a curved rear camber.
Figure 20:
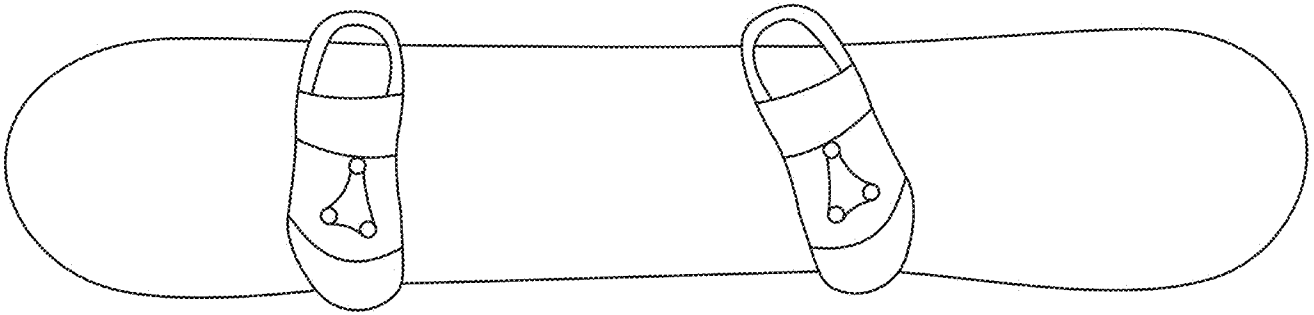
FIG. 20 shows a snowboard, with mounts and boots, from above.

Certain "camber position" technologies may relate more specifically to directional snowboards; such boards may comprise a rear tip section 53 at a rear end 51 of the directional snowboard and a front tip section 54 at a front end 52 of the directional snowboard; and an intermediate longitudinal section 56 between the rear and front tip sections, where the intermediate longitudinal section includes a rear intermediate section half 59 in contact with the rear tip section and a front intermediate section half 60 in contact with the front tip section, the directional snowboard further comprising: a rear camber 61 defined by a lower surface of at least a part of the rear intermediate section half; and a rocker 21 established between the rear camber and the front tip section, where the rear intermediate section half includes a rear mount region 75 and the front intermediate section half includes a front mount region 76, where the rear camber has two rear camber ends, and where one of the rear camber ends is closer to the front tip section than is the other of the rear camber ends and the one of the rear camber ends that is closer to the front tip section is established between the rear mount region and the rear tip section. Of course, as mentioned, the term "between" as used in this application, does not require that the thing that is between two other things/items/locations contact (abut, be immediately adjacent to) such other things/items/locations. It is also of note that certain of the directional snowboard figures (e.g., 18B) may serve not only to show certain weighted board profiles, but also to show certain unweighted, directional board "camber position" embodiments as described in this paragraph. Of course, the rocker shown in FIG. 18B is merely exemplary; as in the embodiments described above (whose description includes the terms "first intermediate section half" and "second intermediate section half"), any other rockers (e.g., entirely curved rockers) could be used, and certainly be more pronounced than shown in, e.g., FIG. 18B.

In the directional board "camber position" technologies, the rear tip section has a rear tip section terminus, and in certain embodiments thereof, a rear snowboard portion from and including the rear tip section terminus to and including the one of the rear camber ends that is closer to the rear tip section than is the other of the rear camber ends does not at any point contact a horizontal surface underlying the directional snowboard when the directional snowboard is unweighted. In particular directional board "camber position" embodiments, at least one point of the rear snowboard portion contacts the horizontal surface underlying the snowboard when a 150 lb. boarder is mounted on the directional snowboard. Also, in particular of the directional board "camber position" embodiments, the one of the rear camber ends that is closer to the front tip section does not contact a horizontal surface underlying the directional snowboard when the directional snowboard is unweighted. Further, it is of note that the one of the rear camber ends that is closer to the front tip section may contact the horizontal surface underlying the directional snowboard when a 150 lb. boarder is mounted on the directional snowboard. Of course, any rockers or camber of the directional board "camber position" technologies may be as described elsewhere in this patent application.

It is of note that the board may be of varied thickness (in a vertical direction), although indeed it can be of the same thickness along its entire length and width. Often, however, board thickness (height) is adjusted and manipulated to provide greater flex in certain areas and greater stiffness in others.

All boards have an orthogonal profile (where orthogonal profile refers to that cross-sectional profile that may be observed when the board is cut in a direction that is orthogonal to its longitudinal axis). Such profile may be non-horizontal (contoured in some fashion) or substantially horizontal (which includes the case where the very outer edges (front and back edges to a mounted boarder) turn up a bit and the rest of the orthogonal profile is horizontal, and the case where the board is horizontal and flat, edge to edge). Of course, a certain longitudinal part(s) of the board may have a substantially horizontal orthogonal profile while another part(s) of the board has a non-horizontal orthogonal profile. Non-horizontal orthogonal profiles include but are not limited to cambered (whether single or otherwise) orthogonal profiles, and V-shaped orthogonal profiles (ignoring what may happen at the very edges). Any of the orthogonal profiles mentioned herein, whether different (changing) along a board's length, the same orthogonal profile along its length, horizontal orthogonal profile or non-horizontal orthogonal profile, may be reflected in the inventive technology. The inventive boards can have any shape between the edges. Generally, the longitudinal profile (distinct from the orthogonal profile) that is a focus of the inventive technology follows that part of the lower surface of the board, from tip terminus to tip terminus, that is lowest and defines the shortest total distance from tip to tip. Typically, such lowest, shortest path is unbroken (as is the case where, e.g., the orthogonal profile does not change at all along a board's entire length). When the profile is substantially horizontal along the entire length of the board, or V-shaped along the entire length of the board, such lowest, shortest path would be along the longitudinal centerline of the board (and would result in a profile that one would observe if the board were split down its longitudinal center). However, in cases having a different orthogonal profile (e.g., symmetrically cambered), such path would not be down the longitudinal center of the board—it would be along one of the low points on either side of the camber (and it would be unbroken where such profile were from tip section to tip section, and the tip sections were either of the same cambered profile or horizontal). It is of note, however, that sometimes the profile is formed upon aggregating two or more segments of a broken path that defines the lowest points of the snowboard from tip terminus to tip terminus, and so as to define the shortest such path. This might occur where one longitudinal board section has an orthogonal profile that is of one orthogonal shape (e.g., cambered) and quickly transitions to a different orthogonal, non-horizontal shape (e.g., rockered) at an adjoining longitudinal section. Such transition could be made smooth and gradual, such that a lowest, shortest path would not be broken. It is of note that the longitudinal profiles shown in FIGS. 1-19 show the lowest lower surface of the board in the shortest total tip to tip travel path; they apply to any conceivable orthogonal profile (each of FIGS. 1-19 shows a longitudinal profile of a board having any of a conceivably infinite number of orthogonal profiles).

It is of note that heights by which portions or points on the lower surface of a board may be above an underlying horizontal surface may be any of a wide range of values, as indeed may curvatures and angles. Apices of cambers may, in a weighted board mode, be anywhere from 0.1 mm to 15 mm inclusive above a horizontal surface underlying the board, although such range is not exhaustive. Where either or both camber ends are off the surface of the underlying surface when the board is in unweighted mode, ends may be off the surface by 0.1 mm to 10 mm inclusive (and it is certainly not the case that they need to be off the surface by the same amount). Angles of flat sections may be anywhere from 0-90 degrees (where 90 degree sections may be parts of small jags or steps). Radii of curvature may be anywhere from 0.1 mm to very gradually curving values upwards of even 10 m (and may vary along a single curve). Board lengths are not necessarily any different from what is seen conventionally in the snowboard industry. Boards may be manufactured using any of several well know materials, including but not limited to fiberglass, metal edge, carbon fiber, epoxy, wood, polyethylene base, elastomeric foil (as but a few possible materials) and any of several well known methods, including but not limited to laminate lay up and thermal pressing. It is of note that the figures may show dimensions, shapes, and relative proportions and distances (whether in the vertical or horizontal dimension) in a manner that is not perfectly to scale with regard to actual dimensions, shapes, angles, and relative proportions and distances observed with actual boards that reflect the inventive technology. This may be done because often, the shapes and the changes in actual profile shapes may be subtle and difficult to discern to the naked eye, and it is desired to clearly show examples of the wide variety of shapes and configurations that the inventive designs may take.

It is of note that the inventive technology includes inventive methods (in addition to inventive apparatus). An inventive snowboard manufacturing method may comprise: establishing a first tip section 3 at a first end 1 of the snowboard and a second tip section 4 at a second end 2 of the snowboard (of course, this may be done by the well know, aforementioned manufacturing methods such as laminate layup and thermal pressing); and establishing an intermediate longitudinal section 6 between the first and second tip sections, wherein the first tip section has a first tip section terminus 7 and the second tip section has a second tip section terminus 8, wherein the intermediate longitudinal section includes a first intermediate section half 9 in contact with the first tip section and a second intermediate section half 10 in contact with the second tip section, wherein at least a part of the first intermediate section half has a lower surface that defines a first camber 11 and at least a part of the second intermediate section half has a lower surface that defines a second camber 12, herein the first camber has two first camber ends and one of the first camber ends is closer to the first tip section than is the other of the first camber ends, wherein the second camber has two second camber ends and one of the second camber ends is closer to the second tip section than is the other of the second camber ends, and shaping the snowboard (e.g., by any conventional manufacturing techniques such as laminate layup and thermal pressing) so that at least one of: a first snowboard portion 13 from and including the first tip section terminus to and including the one of the first camber ends that is closer to the first tip section; and a second snowboard portion 14 from and including the second tip section terminus to and including the one of the second camber ends that is closer to the second tip section, does not at any point contact a horizontal surface 20 underlying the snowboard when the snowboard is unweighted.

Figure 21:
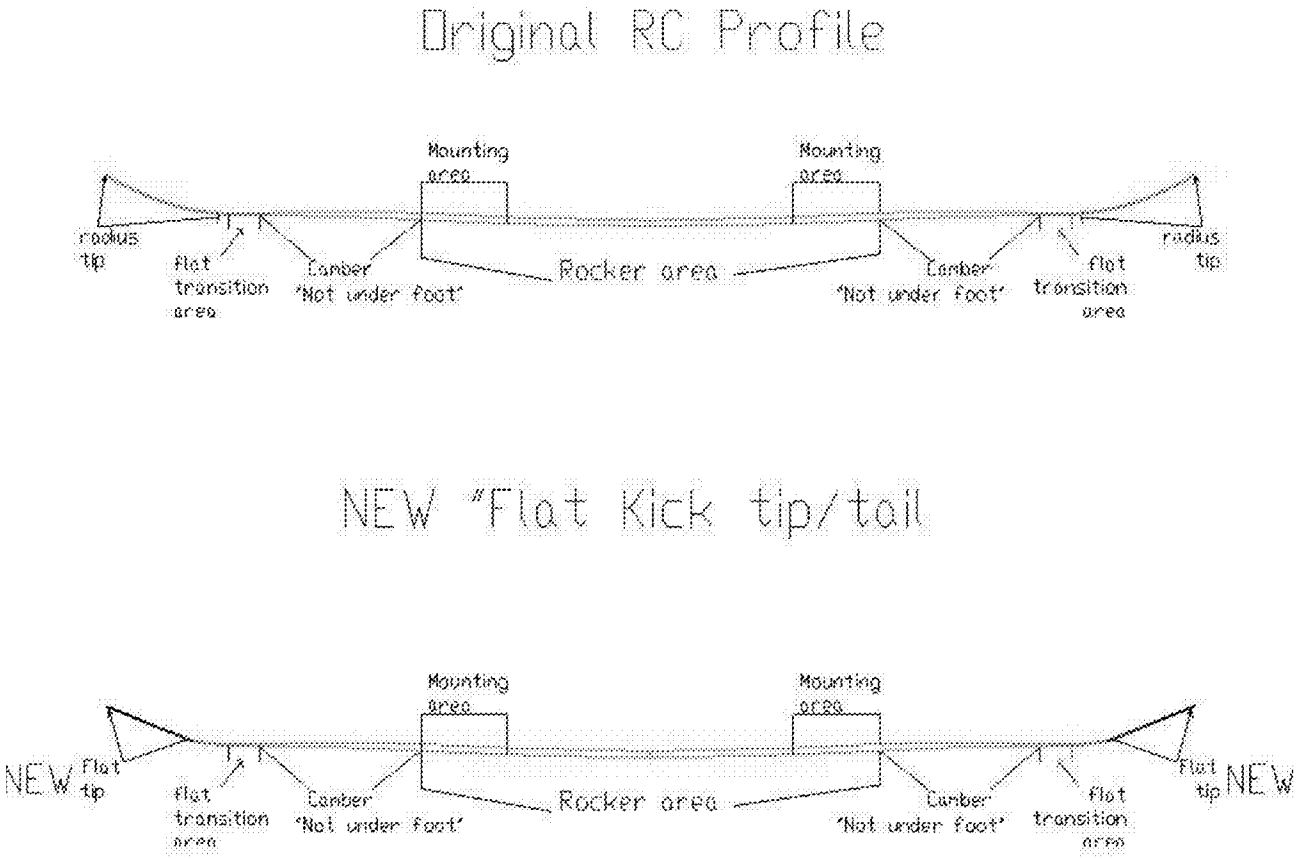
FIG. 21 shows one embodiment of a bi-directional snowboard having the rocker camber shape, and flat tip sections.

It is noteworthy that in some embodiments, the first tip section and the second tip section may have flat lower surfaces. While tip sections having lower surfaces that have a curved profile (e.g., a radius tip) may be preferred in certain embodiments, other embodiments may have tip sections that have a flat lower surface. It is of note that regardless of the profile, such shape may exist from the outboard part (i.e., the part nearest the nearest tip) of a transition section (where the camber transitions into the tip section profile, whether it be flat or curved) to the terminus of that tip. In certain embodiments, there may be a mix of profiles—curved and flat—of the lower surface3s of the tip sections. Indeed, at least a portion of the tip section(s) may have a flat lower surface (perhaps that extends to the terminus). Any of the aforementioned profiles (and indeed others) may be found on the bi-directional and unidirectional boards. FIG. 21 shows one embodiment of a bi-directional snowboard having the rocker camber shape, and flat tip sections.

As mentioned earlier, the present invention includes a variety of aspects, which may be combined in different ways. The following descriptions are provided to list elements and describe some of the embodiments of the present invention. These elements are listed with initial embodiments, however it should be understood that they may be combined in any manner and in any number to create additional embodiments. The variously described examples and preferred embodiments should not be construed to limit the present invention to only the explicitly described systems, techniques, and applications. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

As can be easily understood from the foregoing, the basic concepts of the present invention may be embodied in a variety of ways. It involves both snowboard desing techniques as well as devices to accomplish the appropriate design. In this application, the design techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims that will be included in any subsequent patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon when drafting the claims for any subsequent patent application. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "shape" should be understood to encompass disclosure of the act of "shaping"—whether explicitly discussed or not—and, conversely, were there effectively disclosure of the act of "shaping", such a disclosure should be understood to encompass disclosure of a "shape" and even a "means for shaping" Such changes and alternative terms are to be understood to be explicitly included in the description.

Any acts of law, statutes, regulations, or rules mentioned in this application for patent; or patents, publications, or other references mentioned in this application for patent are hereby incorporated by reference. Any priority case(s) claimed by this application is hereby appended and hereby incorporated by reference. In addition, as to each term used it should be understood that unless its utilization in this application is inconsistent with a broadly supporting interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the list of References To Be Incorporated By Reference In Accordance With The Provisional Patent Application or other information statement filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicant(s).

Thus, the applicant(s) should be understood to have support to claim and make a statement of invention to at least: i) each of the snowboard and snowboard design devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) the various combinations and permutations of each of the elements disclosed, xii) each potentially dependent claim or concept as a dependency on each and every one of the independent claims or concepts presented, and xiii) all inventions described herein.

With regard to claims whether now or later presented for examination, it should be understood that for practical reasons and so as to avoid great expansion of the examination burden, the applicant may at any time present only initial claims or perhaps only initial claims with only initial dependencies. The office and any third persons interested in potential scope of this or subsequent applications should understand that broader claims may be presented at a later date in this case, in a case claiming the benefit of this case, or in any continuation in spite of any preliminary amendments, other amendments, claim language, or arguments presented, thus throughout the pendency of any case there is no intention to disclaim or surrender any potential subject matter. It should be understood that if or when broader claims are presented, such may require that any relevant prior art that may have been considered at any prior time may need to be re-visited since it is possible that to the extent any amendments, claim language, or arguments presented in this or any subsequent application are considered as made to avoid such prior art, such reasons may be eliminated by later presented claims or the like. Both the examiner and any person otherwise interested in existing or later potential coverage, or considering if there has at any time been any possibility of an indication of disclaimer or surrender of potential coverage, should be aware that no such surrender or disclaimer is ever intended or ever exists in this or any subsequent application. Limitations such as arose in Hakim v. Cannon Avent Group, PLC, 479 F.3d 1313 (Fed. Cir 2007), or the like are expressly not intended in this or any subsequent related matter. In addition, support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible.

Finally, any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

What is claimed is:

1. A snowboard, comprising:

a first tip section at a first end of said snowboard and a second tip section at a second end of said snowboard; and an intermediate longitudinal section between said first and second tip sections, wherein said first tip section has a first tip section terminus and said second tip section has a second tip section terminus, wherein said intermediate longitudinal section includes a first intermediate section half in contact with said first tip section and a second intermediate section half in contact with said second tip section, wherein said intermediate longitudinal section has as lower surface that defines three cambers, wherein said three cambers include a first camber that is closest to said first tip section, a second camber that is closest to said second tip section, and a third camber disposed between said first camber and said second camber.

2. A snowboard as described in claim 1 wherein said third camber is centrally located between said first tip section terminus and said second tip section terminus.

3. A snowboard as described in claim 1 wherein said third camber is part of a rocker that is defined by the lower surface of said intermediate section, and that is between said first and second cambers.

4. A snowboard as described in claim 3 wherein said rocker provides an overall rocker shape to said snowboard.

5. A snowboard as described in claim 1 wherein said snowboard, when unweighted, contacts a horizontal surface underlying said snowboard at only two sites, a first of which is between said first camber and said third camber, and a second of which is between said second camber and said third camber.

6. A snowboard as described in claim 1:

wherein at least a part of said first intermediate section half has a lower surface that defines said first camber and at least a part of said second intermediate section half has a lower surface that defines a second camber, wherein said first camber has two first camber ends and one of said first camber ends is closer to said first tip section than is the other of said first camber ends, wherein said second camber has two second camber ends and one of said second camber ends is closer to said second tip section than is the other of said second camber ends, wherein, from and including said first tip section terminus to and including said one of said first camber ends that is closer to said first tip section defines a first snowboard portion, wherein, from and including said second tip section terminus to and including said one of said second camber ends that is closer to said second tip section defines a second snowboard portion, wherein said first snowboard portion does not at any point contact a horizontal surface underlying said snowboard when said snowboard is unweighted.

7. A snowboard as described in claim 6 wherein both said first snowboard portion and said second snowboard portion do not at any point contact said horizontal surface underlying said snowboard when said snowboard is unweighted.

8. A snowboard as described in claim 1 wherein said third camber is part of a rocker.

9. A snowboard as described in claim 1 wherein said rocker is curved.

10. A snowboard as described in claim 1 wherein said first camber is curved.

11. A snowboard as described in claim 1 wherein said second camber is curved.

12. A snowboard as described in claim 1 wherein said third camber is curved.

13. A snowboard as described in claim 1 wherein said first camber has an upside-down V-shape.

14. A snowboard as described in claim 1 wherein said second camber has an upside-down V-shape.

15. A snowboard as described in claim 1 wherein said third camber has an upside-down V-shape.

16. A snowboard as described in claim 1 wherein said first camber has an intermediate flat section between two curved sections.

17. A snowboard as described in claim 1 wherein said second camber has an intermediate flat section between two curved sections.

18. A snowboard as described in claim 1 wherein said third camber has an intermediate flat section between two curved sections.

19. A snowboard as described in claim 1 wherein said first camber has an intermediate flat section between two downwardly angled flat sections.

20. A snowboard as described in claim 1 wherein said second camber has an intermediate flat section between two downwardly angled flat sections.

21. A snowboard as described in claim 1 wherein said third camber has an intermediate flat section between two downwardly angled flat sections.

22. A snowboard as described in claim 21 wherein at least a portion of the lower board surface underlying mounting zones of said snowboard, and an outer end of each of said first camber and said second camber, contacts a horizontal surface underlying said snowboard when a 150 lb. boarder is mounted on said snowboard.

* * * * *